US006446473B1

(12) United States Patent
Park et al.

(10) Patent No.: US 6,446,473 B1
(45) Date of Patent: Sep. 10, 2002

(54) WASHING MACHINE

(75) Inventors: Jin Soo Park, Inchon-si; Jun Ho Ahn, Seoul-si, both of (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/810,218

(22) Filed: Mar. 19, 2001

(30) Foreign Application Priority Data

Oct. 4, 2000 (KR) ..... 2000-58257

(51) Int. Cl.[7] ..... D06F 21/08
(52) U.S. Cl. ..... 68/156
(58) Field of Search ..... 68/148, 151, 156, 68/171, 174

(56) References Cited

U.S. PATENT DOCUMENTS 1,393,641 A * 10/1921 Richardson ..... 68/156 X
1,737,480 A * 11/1929 Troy ..... 68/156
2,101,634 A * 12/1937 Aldridge ..... 68/148 X
3,512,539 A * 5/1970 Hamilton ..... 68/156 X

FOREIGN PATENT DOCUMENTS

DE 632065 * 7/1936 ..... 68/156
FR 949820 * 3/1949 ..... 68/156

* cited by examiner

*Primary Examiner*—Philip Coe
(74) *Attorney, Agent, or Firm*—Birch, Stewart, Kolasch & Birch, LLP

(57) ABSTRACT

A washing machine, with an inner tub designed to be linearly reciprocable along its vertical axis in addition to being rotatable on the vertical axis during the washing or rinsing process, is disclosed. In the washing machine, a washing tub is suspended within a cabinet forming the profile of the washing machine and having an openable cover at its top end. The washing tub consists of an outer tub suspended within the cabinet and containing water therein, and a perforated inner tub set within the outer tub. This inner tub contains laundries therein, and washes or rinses the laundries during the washing or rinsing process. A drive unit is mounted to the bottom of the outer tub, and rotates and vertically reciprocates the inner tub within a predetermined stroke. The washing machine of this invention thus forms vertical moving currents of water in addition to active swirling currents of water within the inner tub, and prevents laundries from being twisted during the washing or rinsing process. The washing machine is also improved in its rinsing and detergent dissolving performance, and is improved in its overall laundering effect.

10 Claims, 3 Drawing Sheets

WASHING MACHINE

BACKGROUND OF THE INVENTION

1. Field of the Invention

The present invention relates to washing machines and, more particularly, to a washing machine with an inner tub designed to be linearly reciprocable along its vertical axis in addition to being rotatable on said vertical axis, thus preventing laundries from being twisted during the washing or rinsing process and improving the laundering effect of the washing machine.

2. Description of the Prior Art

FIG. 1 is a sectional view, showing the construction of a conventional washing machine with an upright washing tub.

As shown in the drawing, the conventional washing machine has an upright washing tub, concentrically suspended within a cabinet 104. This cabinet 104 forms the profile of the washing machine, and is provided with an openable cover 102 at its top end, while the washing tub comprises an outer tub 106 and a perforated rotary inner tub 108. The outer tub 106 is suspended within the cabinet 104 by a plurality of suspension arms 112, and contains water therein during the washing or rinsing process, while the perforated inner tub 108 is concentrically set within the outer tub 106, and is rotatable to wash or rinse the laundries contained therein. A drive motor 110 is installed at a position under the center of the bottom wall of the washing tub to rotate the inner tub 108 at a desired speed. The suspension arms 112 hold the outer tub 106 of the suspended washing tub within the cabinet 104, and act as a means for absorbing undesirable shocks or vibrations during the operation of the washing machine.

In the drive motor 110, a rotor 120 is integrated with a motor shaft 116, while a stator 122 surrounds the rotor 120 such that a regular gap is formed between the rotor 120 and the stator 122.

The motor shaft 116 integrally extends from the center of the rotor 120, and passes through the center of the bottom wall of the outer tub 106, with a bearing 118 set closely between the outer tub 106 and the motor shaft 116 to rotatably hold the shaft 116 relative to the outer tub 106. The upper end of the motor shaft 116, projected from the bottom wall of the outer tub 106, is fixed to the center of the bottom wall of the inner tub 108.

In the above-mentioned drive motor 110, the rotor 120 is integrated with the motor shaft 116, so that the shaft 116 holds the rotor 120 at a desired position. The stator 122 is fixedly set within a motor housing 126, which is fixed to the bottom wall of the outer tub 106.

When such a conventional washing machine is turned on, electric power is applied to the stator 122 of the drive motor 110, and so a rotating magnetic field is formed in the motor 110 by the coil wound around the stator 122, thus rotating the rotor 120 together with the motor shaft 116. The inner tub 108 of the washing tube is thus rotated relative to the outer tub 106 by the motor shaft 116, and forms active swirling currents of water within the inner tub 108 thus washing or rinsing the laundries. After a washing or rinsing process, water is discharged from the washing tub to the outside of the cabinet 104 through a drain hose. After the draining process, the washing machine typically performs a dewatering process to remove water together with detergent components from the laundries by rotating the inner tub 106 at a high speed.

However, such a conventional washing machine is problematic in that the inner tub of the washing tub is designed to only rotate on its vertical axis, and so the laundries are undesirably twisted during a washing or rinsing process. Another problem experienced in conventional washing machines with such a washing tub resides in that its rinsing and detergent dissolving performance is reduced, and so the washing machine does not accomplish the desired laundering effect.

SUMMARY OF THE INVENTION

Accordingly, the present invention has been made keeping in mind the above problems occurring in the prior art, and an object of the present invention is to provide a washing machine, of which the inner tub is designed to be linearly reciprocable along its vertical axis in addition to being rotatable on the vertical axis during a washing or rinsing process, and which thus forms vertical moving currents of water in addition to active swirling currents of water within the inner tub, thus preventing laundries from being twisted during the washing or rinsing process and which is thus improved in its overall laundering effect.

In order to accomplish the above object, the present invention provides a washing machine, comprising: a cabinet forming the profile of the washing machine, and provided with an openable cover at its top end; a washing tub suspended within the cabinet, and consisting of an outer tub suspended within the cabinet and containing water therein during the washing or rinsing process, and a perforated inner tub set within the outer tub such that the inner tub is linearly reciprocable along its vertical axis in addition to being rotatable on the vertical axis, the inner tub containing laundries therein and washing or rinsing the laundries during the washing or rinsing process; and a drive unit used for rotating and vertically reciprocating the inner tub within a predetermined stroke.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE INVENTION

Figure 1:
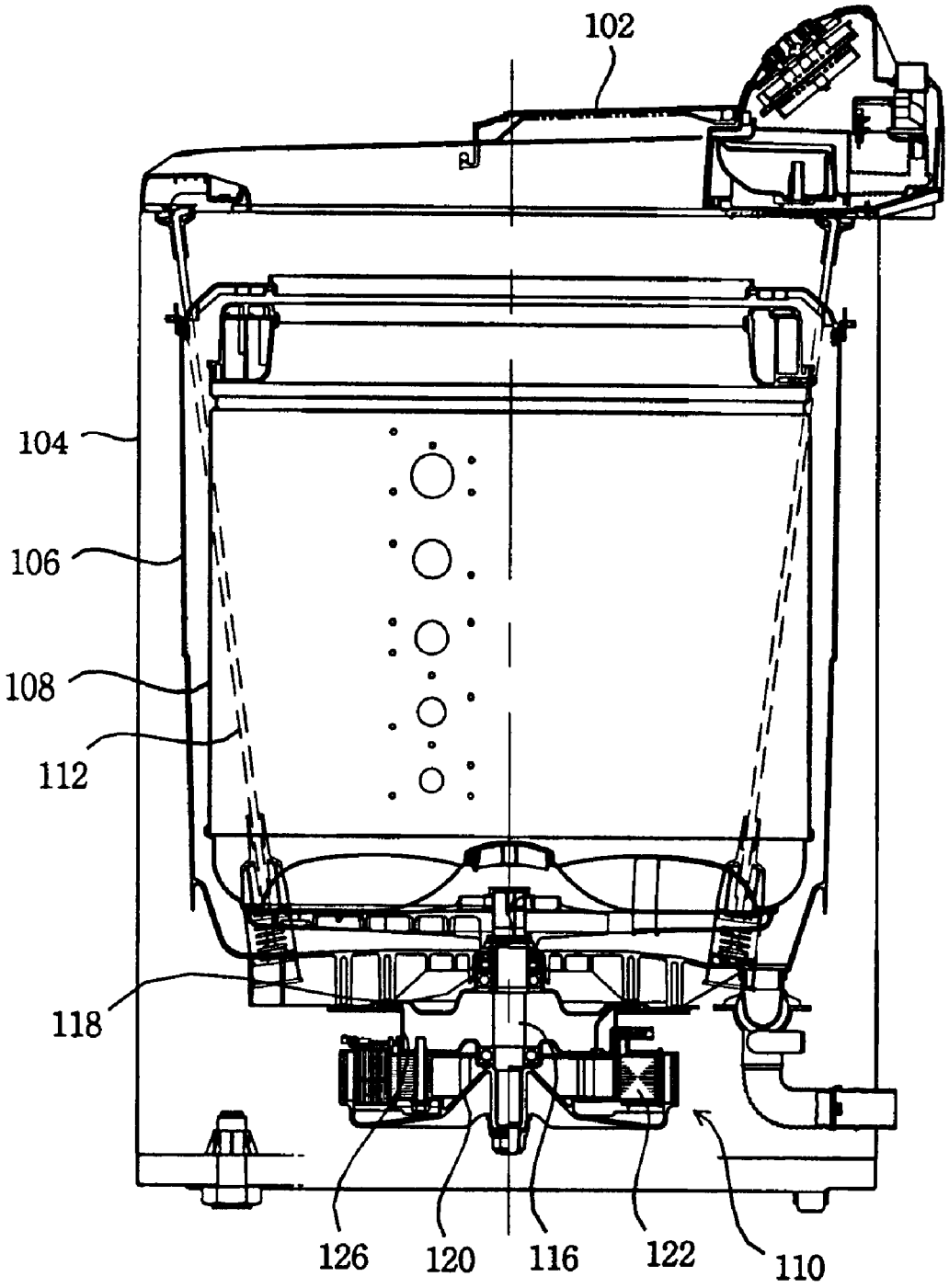
FIG.1 (Prior Art)
FIG. 1 is a sectional view, showing the construction of a conventional washing machine with an upright washing tub.
Figure 2:
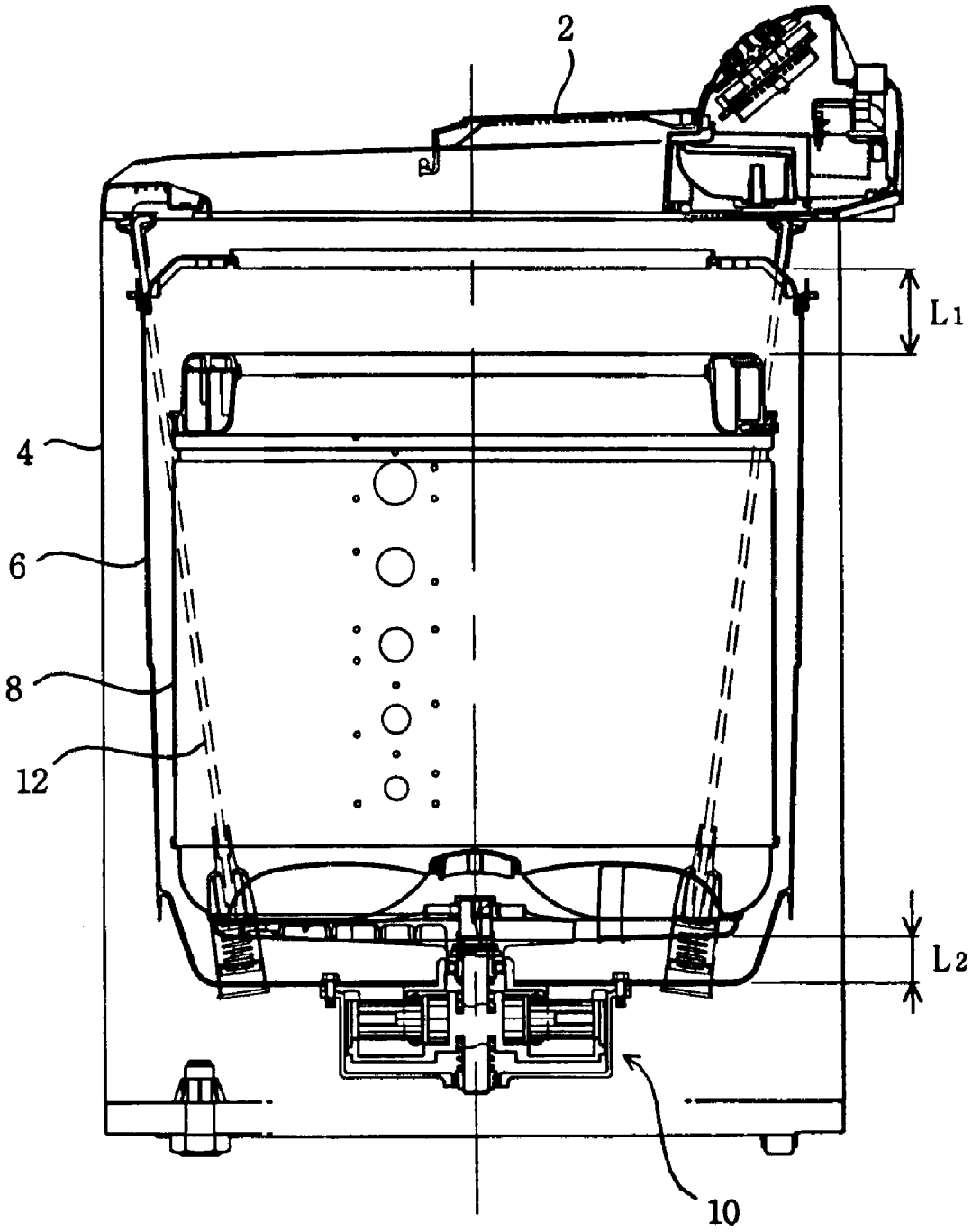
FIG. 2 is a sectional view, showing the construction of a washing machine in accordance with the preferred embodiment of the present invention.

FIG. 2 is a sectional view, showing the construction of a washing machine in accordance with the preferred, embodiment of the present invention.

As shown in the drawing, the washing machine has an upright washing tub, concentrically suspended within a cabinet 4. This cabinet 4 forms the profile of the washing machine, and is provided with an openable cover 2 at its top end, while the washing tub comprises an outer tub 6 and a perforated inner tub 8. The outer tub 6 is suspended within the cabinet 4 by a plurality of suspension arms 12, and contains water therein during the washing or rinsing process. The perforated inner tub 8 is concentrically set within the outer tub 6 such that the tub 8 is linearly reciprocable along its vertical axis in addition to being rotatable on the vertical axis, thus washing or rinsing laundries during the washing or rinsing process. A drive unit 10 is installed at a position under the center of the bottom wall of the washing tub to rotate and vertically move the inner tub 8. The suspension arms 12 hold the outer tub 6 of the suspended washing tub within the cabinet 4, and act as a means for absorbing undesirable shocks or vibrations during the operation of the washing machine.

In order to prevent the inner tub 8 from being undesirably brought into contact with the outer tub 6 during the vertical reciprocating action of the inner tub 8 within the outer tub 6, the inner tub 8 is set within the outer tub 6 such that a predetermined gap is left between the two tubs 6 and 8. That is, the normal position of the movable inner tub 8 within the outer tub 6 is set such that the inner tub 8 does not come into contact with the outer tub 6 at its upper and lower ends or is unexpectedly impacted by the outer tub 6 during the vertical reciprocating action of the inner tub 8 within the outer tub 6. Such an object is accomplished by leaving an upper gap $L_1$ between the upper ends of the two tubs 6 and 8 and a lower gap $L_2$ the lower ends of the two tubs 6 and 8. In such a case, the upper gap $L_1$ is set such that upper end of the outer tub 6 is positioned higher than the upper end of the inner tub 8 in its uppermost position, while the lower gap $L_2$ is set such that bottom wall of the outer tub 6 is positioned lower than the bottom wall of the inner tub 8 in its lowermost position.

Figure 3:
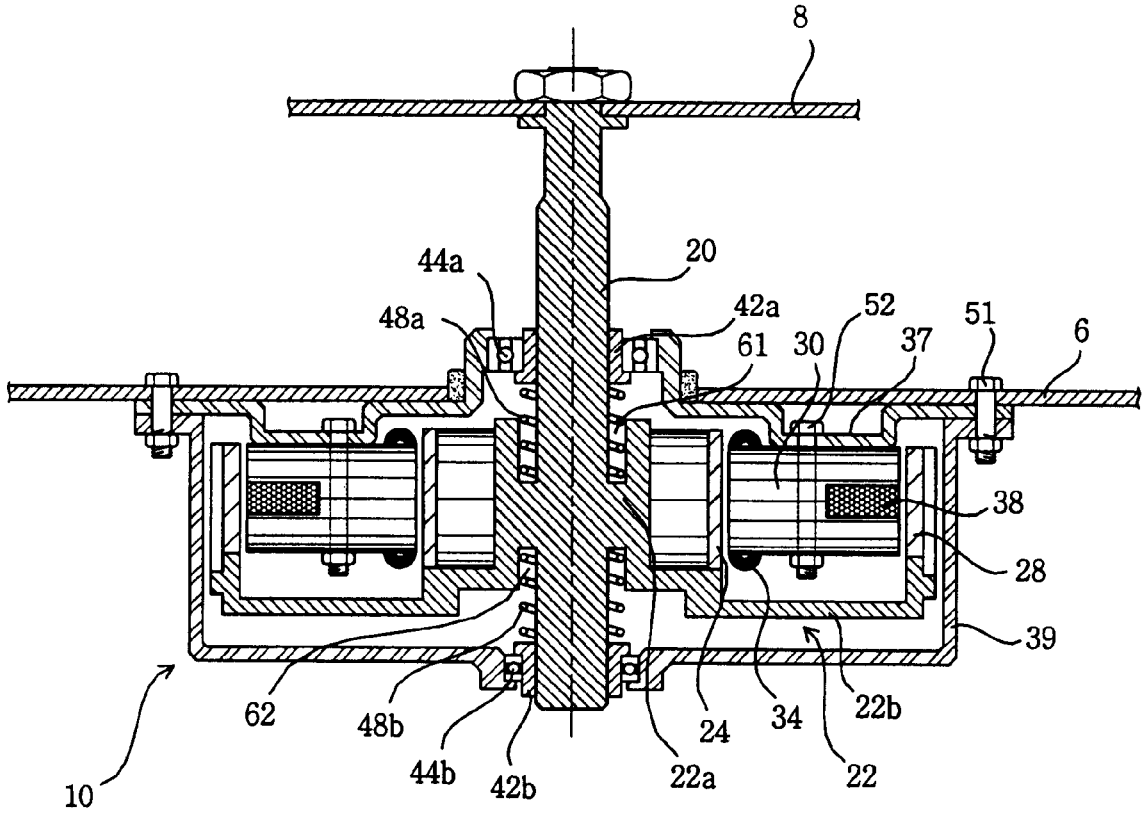
FIG. 3 is a sectional view, showing the construction of a drive unit for the washing machine of the present invention.

The drive unit 10 rotates and vertically reciprocates the inner tub 8 within the outer tub 6 to form desired vertical currents and active swirling currents of water within the inner tub 8. As best seen in FIG. 3, the drive unit 10 comprises a vertically positioned motor shaft 20 fixed to the center of the bottom wall of the inner tub 8 at its upper end, with a rotor frame 22 integrated with the lower portion of the motor shaft 20. A first annular magnet 24 is firmly fitted over the inside hub 22*a* of the rotor frame 22 to rotate the motor shaft 20 on the vertical axis, while a second annular magnet 28 is firmly set along the outside edge of the rotor frame 22 to vertically move the motor shaft 20 in opposite directions within a predetermined stroke. A stator 30 is set between the first and second magnets 24 and 28 while being spaced apart from both magnets 24 and 28 at predetermined gaps. The drive unit 10 also comprises a first stator core 34, which is formed by a first coil wound around the inside edge of the stator 30 and selectively rotates the first magnet 24 when the core 34 is electrically activated. A second coil is circumferentially wound around the outside edge of the stator 30, thus forming a second stator core 38, which selectively and vertically moves the second magnet 28 when the core 38 is electrically activated.

The rotor frame 22, integrated with the motor shaft 20, comprises the inside hub 22*a* and a disc 22*b*. The inside hub 22*a* is integrated with the shaft 20 by a radial rib, with upper and lower annular gaps 61 and 62 formed between the shaft 20 and the hub 22*a* at opposite positions of the radial rib. This inside hub 22*a* thus has an inner diameter larger than the outer diameter of the shaft 20. The disc 22*b* integrally extends from the lower edge of the inside hub 22*a* outward in a radial direction.

An upper cover 37 is mounted to the external surface of the bottom wall of the outer tub 6 at a position above the rotor frame 22 using a plurality of first setscrews 51. The stator 30 is fixed to the lower surface of the upper cover 37 using a plurality of second setscrews 52.

A lower cover 39, having a shape covering the bottom wall and outside edge of the rotor frame 22, is mounted to the external surface of the bottom wall of the outer tub 6 such that the screw holes of the lower cover 39 are aligned with the screw holes of the upper cover 37 and are tightened together with the upper cover 27 by the first set screws 51.

In the washing machine of this invention, the motor shaft 20 must be movably held in the upper and lower covers 37 and 39 such that the shaft 20 is rotatable and vertically movable relative to the two covers 37 and 39. In order to accomplish the above object, upper and lower sleeve bearings 42*a* and 42*b* are movably fitted over the shaft 20 at positions around the two covers 37 and 39, with both a radial bearing 44*a* set within the annular gap between the upper cover 37 and the upper sleeve bearing 42*a* and a thrust bearing 44*b* set within the annular gap between the lower cover 39 and the lower sleeve bearing 42*b*.

A shaft biasing means is fitted over the shaft 20 at a predetermined position for elastically supporting the shaft 20 when the shaft 20 vertically moves in opposite directions.

In the preferred embodiment of the present invention, the shaft biasing means comprises first and second coil springs 48*a* and 48*b*. The first spring 48*a* is set within the upper annular gap 61 between the shaft 20 and the upper portion of the inside hub 22*a* while being stopped by both the upper sleeve bearing 42*a* and the radial rib of the rotor frame 22 at opposite ends. The second spring 48*b* is set within the lower annular gap 62 between the shaft 20 and the lower portion of the inside hub 22*a* while being stopped by both the lower sleeve bearing 42*b* and the radial rib of the rotor frame 22 at opposite ends.

The operational effect of the washing machine of this invention will be described herein below.

In order to perform the washing or rinsing process, the coil of the first stator core 34 is electrically activated to rotate the first annular magnet 24 together with the rotor frame 22. Since the rotor frame 22 is integrated with the motor shaft 20, the rotating action of the rotor frame 22 makes the shaft 20 rotate on its vertical axis. Therefore, the inner tub 8 of the washing tub is rotated in the same direction, thus forming desired active swirling currents of water capable of effectively washing or rinsing laundries within the inner tub 8.

In such a washing or rinsing process, the coil of the second stator core 38 is electrically activated simultaneously with the activation of the first stator core 34, thus vertically reciprocating the second annular magnet 28 together with the rotor frame 22 within a predetermined stroke. Such a vertical reciprocating action of the rotor frame 22 makes the shaft 20 to move vertically in opposite directions within the same stroke because the rotor frame 22 is integrated with the motor shaft 20. During this vertical reciprocating action of the shaft 20, the shaft 20 is elastically supported by the two coil springs 48*a* and 48*b*.

Therefore, the inner tub 8 of the washing tub is reciprocated together with the shaft 20, and forms desired active vertical moving currents of water capable of more effectively washing or rinsing laundries within the inner tub 8.

In a brief description, the inner tub 8 of the washing tub provided within the washing machine of this invention is vertically reciprocated within a predetermined stroke in addition to being rotated on its vertical axis during the washing or rinsing process. Therefore, desired active swirling currents and active vertical moving currents of water capable of more effectively washing or rinsing laundries are created within the inner tub 8.

On the other hand, when a dewatering process in the washing machine is desired, the first stator core 34 is electrically activated, while the second stator core 38 is not activated. The inner tub 8 of the washing tub during such a dewatering process is thus not moved in a vertical direction, but is exclusively rotated on its vertical axis at a high speed.

As described above, the present invention provides a washing machine, of which the inner tub of the washing tub is designed to be linearly reciprocable along its vertical axis in addition to being rotatable on the vertical axis during the washing or rinsing process, thus forming vertical moving currents of water in addition to active swirling currents of water within the inner tub. The washing machine thus prevents laundries from being twisted during the washing or rinsing process, and improves its rinsing and detergent dissolving performance, and is improved in its overall laundering effect.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A washing machine, comprising:

a cabinet forming a profile of the washing machine, and provided with an openable cover at its top end;

a washing, tub suspended within said cabinet, said washing tub consisting of:

an outer tub suspended within said cabinet, and containing water therein during a washing or rinsing process; and a perforated inner tub set within said outer tub such that the inner tub is linearly reciprocable along its vertical axis in addition to being rotatable on the vertical axis, said inner tub containing laundries therein and washing or rinsing the laundries during the washing or rinsing process; and a drive unit used for rotating and vertically reciprocating said inner tub within a predetermined stroke.

2. The washing machine according to claim 1, wherein said inner tub is set within the outer tub such that predetermined gaps are left between upper ends of the inner and outer tubs and between lower ends of said inner and outer tubs so as to prevent the inner tub from coming into contact with the outer tub during a reciprocating action of the inner tub within the outer tub.

3. The washing machine according to claim 1, wherein said drive unit comprises:

a motor shaft fixed to a center of a bottom wall of said inner tub at its upper end;

a rotor frame integrated with a lower portion of said motor shaft;

first and second magnets set on said rotor frame, said first magnet being used for rotating the motor shaft on the vertical axis and said second magnet being used for vertically reciprocating the motor shaft along said vertical axis;

a stator set between said first and second magnets while being spaced apart from said magnets at predetermined gaps;

a first stator core formed by a first coil wound around said stator, and used for selectively rotating the first magnet when the first stator core is electrically activated; and a second stator core formed by a second coil wound around said stator, and used for selectively and vertically reciprocating the second magnet.

4. The washing machine according to claim 3, wherein said rotor frame comprises an inside hub integrated with said motor shaft, and a disc integrally extending from a lower edge of said inside hub outward in a radial direction, with said first magnet firmly fitted over said inside hub and said second magnet firmly set along an outside edge of said disc, and said stator set between the first and second magnets.

5. The washing machine according to claim 4, wherein an upper cover is mounted to an external surface of a bottom wall of said outer tub at a position above the rotor frame, with said stator fixed to a lower surface of said upper cover.

6. The washing machine according to claim 5, wherein a sleeve bearing and a radial bearing are set within a gap between said motor shaft and said upper cover.

7. The washing machine according to claim 6, wherein an upper annular gap is formed between the motor shaft and an upper portion of said inside hub, with a first coil spring set within said upper annular gap while being stopped by said sleeve bearing at its upper end.

8. The washing machine according to claim 4, wherein a lower cover is mounted to the external surface of the bottom wall of said outer tub while covering the bottom and outside edge of said rotor frame.

9. The washing machine according to claim 8, wherein a sleeve bearing and a thrust bearing are set within a gap between said motor shaft and said lower cover.

10. The washing machine according to claim 9, wherein a lower annular gap is formed between the motor shaft and a lower portion of said inside hub, with a second coil spring set within said lower annular gap while being stopped by said sleeve bearing at its lower end.

* * * * *